US008534524B2

(12) United States Patent
Bucci et al.

(10) Patent No.: US 8,534,524 B2
(45) Date of Patent: Sep. 17, 2013

(54) PERFORATED TICKET DISPENSING MACHINE

(75) Inventors: Paul Anthony Bucci, Glocester, RI (US); Kurt L. Businger, Warwick, RI (US)

(73) Assignee: GTECH Corporation, Providence, RI (US)

( * ) Notice: Subject to any disclaimer, the term of this patent is extended or adjusted under 35 U.S.C. 154(b) by 461 days.

(21) Appl. No.: 12/900,944

(22) Filed: Oct. 8, 2010

(65) Prior Publication Data

US 2012/0085777 A1 Apr. 12, 2012

(51) Int. Cl.

| | |
|---|---|
| ***B26F 3/00*** | (2006.01) |
| ***B26F 3/02*** | (2006.01) |
| ***B65H 35/00*** | (2006.01) |
| ***B65H 43/00*** | (2006.01) |
| ***B26D 7/00*** | (2006.01) |
| ***B26D 7/06*** | (2006.01) |

(52) U.S. Cl.

USPC ..... 225/103; 83/649; 83/103; 226/11

(58) Field of Classification Search

USPC ..... 225/10, 2, 4, 100, 103, 104, 106, 225/93; 83/649–650, 103–105; 242/563, 242/563.1, 534, 534.1; 226/11, 45, 100

See application file for complete search history.

(56) References Cited

U.S. PATENT DOCUMENTS

| | | | | |
|---|---|---|---|---|
| 2,056,657 | A * | 10/1936 | Everett | 156/461 |
| 3,265,385 | A | 8/1966 | Schulze | |
| 3,894,669 | A | 7/1975 | Wescot | |
| 3,902,677 | A | 9/1975 | Wolf | |
| 3,997,044 | A | 12/1976 | Schasser | |
| 4,367,666 | A * | 1/1983 | Toth | 83/203 |
| 4,788,419 | A | 11/1988 | Walters | |
| 4,982,337 | A | 1/1991 | Burr | |
| 5,018,614 | A | 5/1991 | Ruckert | |
| 5,082,384 | A * | 1/1992 | Kakaguchi | 400/708 |
| 5,160,076 | A | 11/1992 | Ford | |
| 5,222,624 | A | 6/1993 | Burr | |
| 5,224,408 | A * | 7/1993 | Steidinger | 83/674 |
| 5,293,796 | A * | 3/1994 | Zober | 83/42 |
| 5,373,046 | A * | 12/1994 | Okamura et al. | 524/413 |
| 5,461,219 | A | 10/1995 | Cronvall | |
| 5,464,142 | A * | 11/1995 | Mol et al. | 225/100 |
| 5,655,201 | A * | 8/1997 | Islam et al. | 399/322 |

(Continued)

FOREIGN PATENT DOCUMENTS

| | | |
|---|---|---|
| WO | WO9522445 | 8/1995 |
| WO | WO9622933 | 8/1996 |

OTHER PUBLICATIONS

International Search Report and Written Opinion for PCT/US2011/031313, dated Jun. 17, 2011.

*Primary Examiner* — Ghassem Alie
*Assistant Examiner* — Bharat C Patel
(74) *Attorney, Agent, or Firm* — Williams Mullen, PC; Thomas F. Bergert

(57) ABSTRACT

The present invention provides an independently operable and serviceable ticket burster machine that properly handles perforated tickets of all shapes, sizes and thicknesses. The present invention includes a ticket burster element, an exit sensor with a mechanical flag switch, an inventory flag spanning the entire width of the ticket input slot and having an optical slot switch, a slidable ticket guide, one or more leaf spring arrangements and versatile and durable rollers.

7 Claims, 13 Drawing Sheets

(56) References Cited

U.S. PATENT DOCUMENTS

| | | | | |
|---|---|---|---|---|
| 5,785,224 | A * | 7/1998 | Nowakowski | 225/4 |
| 6,056,150 | A | 5/2000 | Kasper | |
| 6,152,631 | A * | 11/2000 | Park | 400/708 |
| 6,517,911 | B1 * | 2/2003 | Matsuki | 427/551 |
| 6,669,071 | B1 * | 12/2003 | Menna | 225/106 |
| 6,726,077 | B2 | 4/2004 | Roberts et al. | |
| 7,381,132 | B2 * | 6/2008 | Roberts | 463/17 |
| 7,386,968 | B2 | 6/2008 | Sperry | |
| 7,562,798 | B2 | 7/2009 | Bartolone et al. | |
| 7,665,394 | B2 | 2/2010 | Roberts | |
| 7,984,871 | B2 * | 7/2011 | Nagata | 242/563.1 |
| 2002/0117528 | A1 | 8/2002 | Turek | |
| 2002/0166882 | A1 * | 11/2002 | Roberts et al. | 225/2 |
| 2004/0000572 | A1 * | 1/2004 | Engelhardt et al. | 225/1 |
| 2004/0200874 | A1 * | 10/2004 | Menna | 225/106 |
| 2005/0056675 | A1 * | 3/2005 | Bartolone et al. | 225/2 |
| 2009/0152292 | A1 | 6/2009 | Mirkovic et al. | |
| 2009/0159610 | A1 | 6/2009 | Woods et al. | |

* cited by examiner

FIG. 10
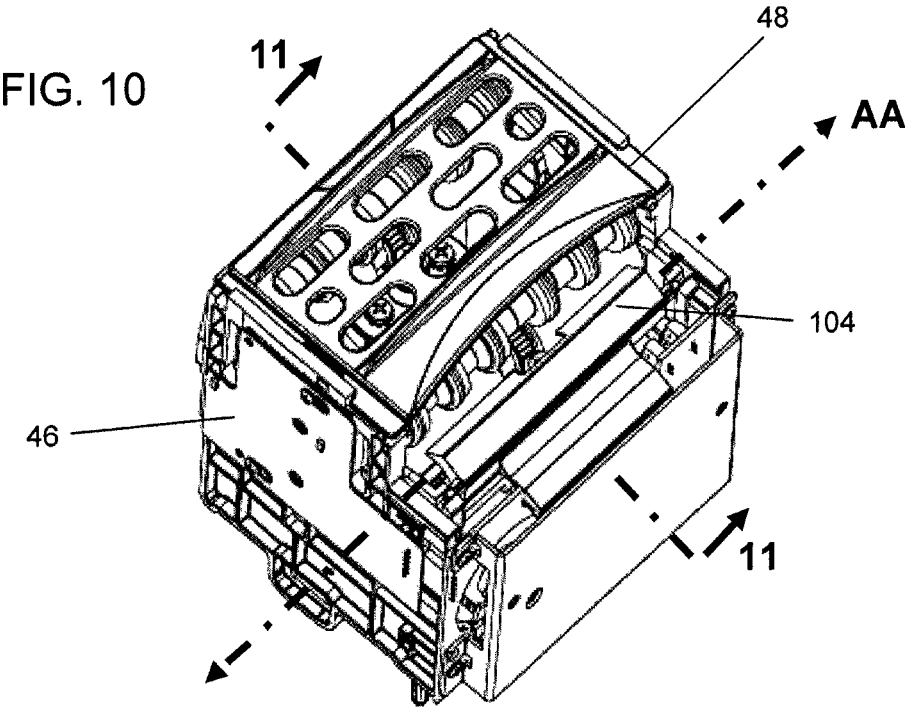
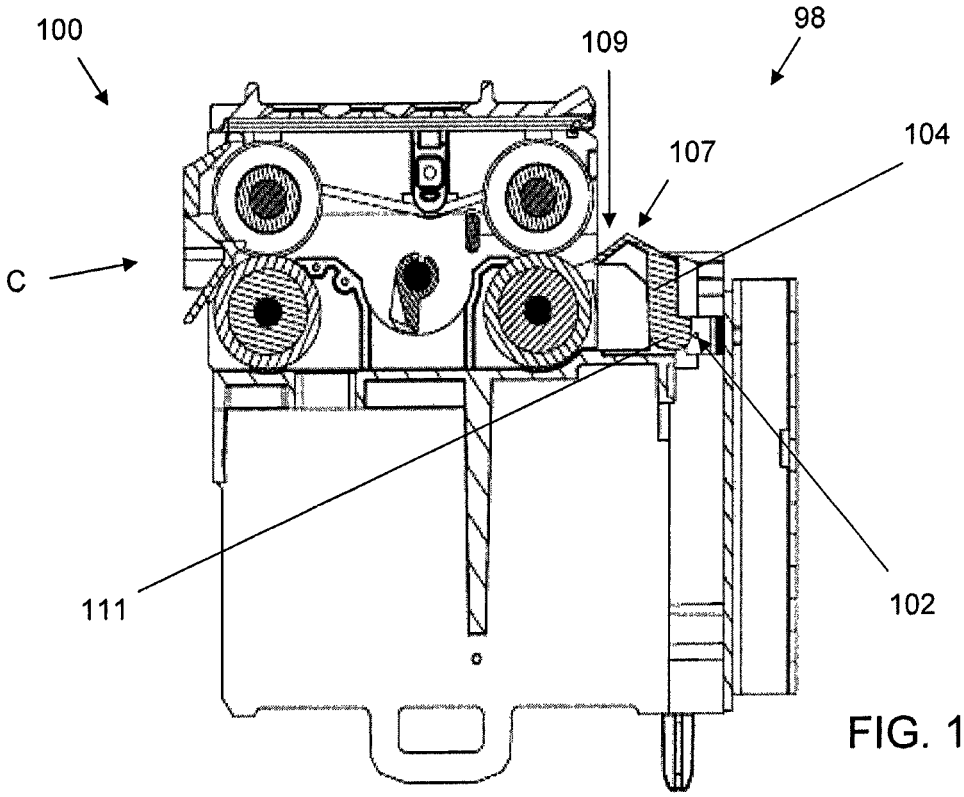
FIG. 11

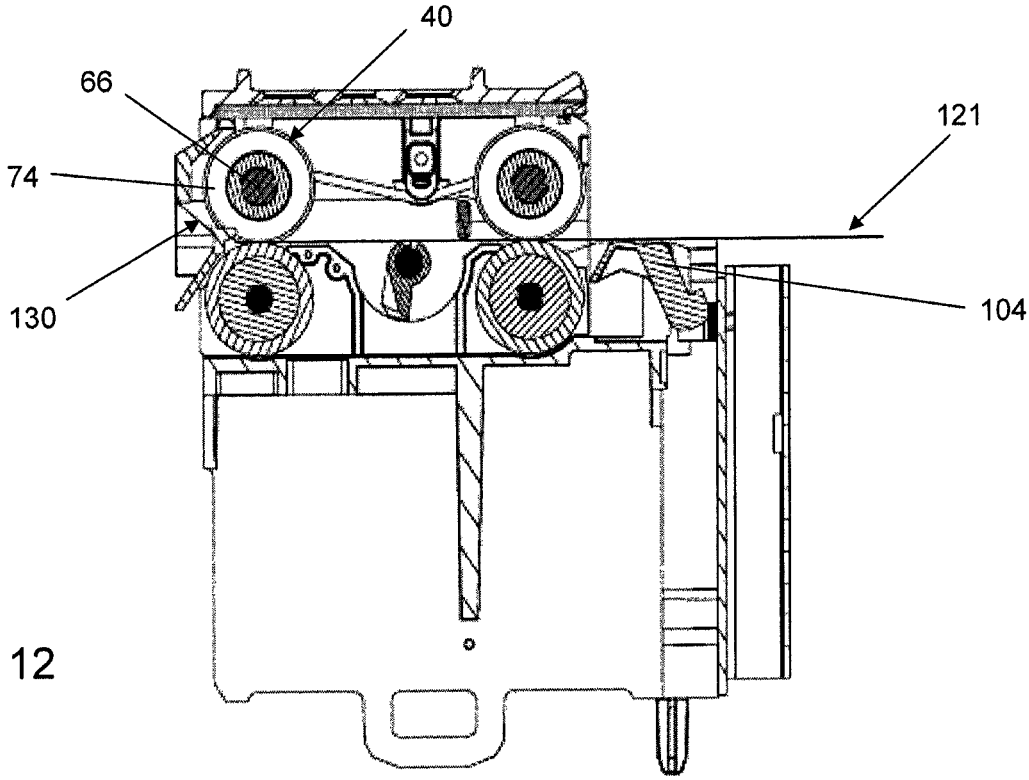
FIG. 12
FIG. 13
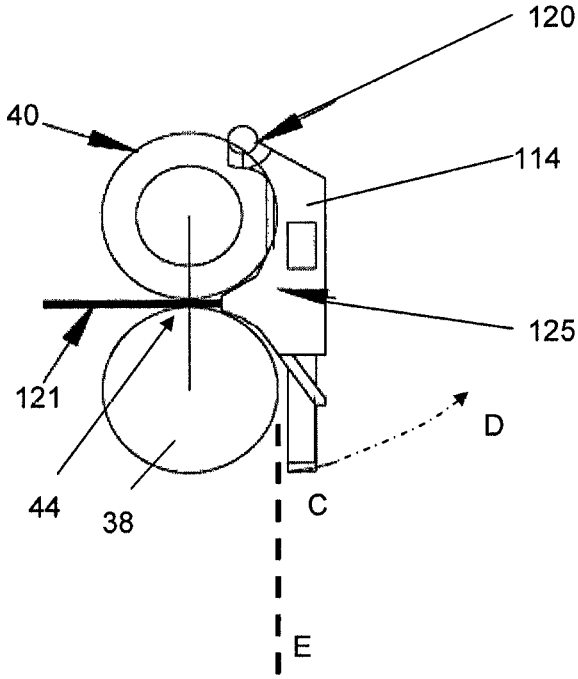

PERFORATED TICKET DISPENSING MACHINE

FIELD OF THE INVENTION

The present invention relates to ticket dispensing machines, and more particularly to a ticket dispensing machine for handling tickets of unconventional shapes and sizes.

BACKGROUND OF THE INVENTION

More and more instant lottery tickets are sold in automatic vending machines. Usually, the instant tickets are printed on a long strip, which may be fan-folded, and the individual tickets are separated by perforations. The ticket width typically varies from 2 to 4 inches and the length typically varies from 2 to 12 inches. However, "die cut" tickets which have irregular shapes are becoming increasingly popular.

During the ticket delivery process, the perforation must be placed very accurately under a cutting or separating system that will burst the perforation and send a single ticket to the presentation stage, such as a bin that allows a purchaser to retrieve a purchased ticket through a window, for example.

FIG. 1 shows a cross section of a typical ticket delivery system 10. As seen therein, the ticket 12 is moved by a feed drive roller 14 from right to left from an entry point A to an exit point B, over the cutting system 16 to the exit rollers 18. The feed drive roller 14 can be driven by a DC motor 20 with a worm gear 22, for example. Attached to the motor is a code wheel 24 which passes through an optical sensor that counts the number of slots in the code wheel 24. The number of slots counted is proportional to the distance the ticket travels. A feed idler roller 15 pushes the ticket 12 against the drive roller 14 to generate enough friction so that the ticket does not slip. The point at which the feed drive roller 14 and feed idler roller 15 meet is called the "nip point". There is a feed roller nip point as well as an exit roller nip point. As the feed drive roller 14 rotates, the ticket 12 is moved by the outer surface of the feed drive roller 14. Once the ticket 12 passes the exit rollers 18, both the exit and feed rollers will move the ticket. As soon as the perforation of the ticket is in the proper position for bursting/cutting, the feed and exit rollers stop, the cutting system 16 bursts the perforation and the ticket is ejected by the exit rollers.

The exact movement of the ticket depends on the diameter of the feed roller as well as the friction of the drive roller system.

In performing the above functions, there is typically an optical sensor device located at or near position B in FIG. 1, which (1) senses the edge of a ticket so it can be precisely positioned relative to the perforation where the ticket must be cut, and (2) senses that the ticket was delivered and left the machine. The optical sensor device is typically embodied in an optical sensor pair containing a transmitter (e.g., light emitting diode (LED)) and a receiver (e.g., a photo transistor). As soon as an object interrupts the light beam, the output of the receiver changes, and this information is sent to the machine's controller. Also, if the sensor is still blocked after the ticket was supposed to be delivered, the controller will be able to shut the machine down.

Whether used on the ticket exit side, ticket entry side, or both, optical sensor pairs are highly affected by dust and dirt and are traditionally only used at one location on the entry and exit sides. Further, if a die cut (e.g., not rectangular-shaped) ticket is used, then the sensor will not always sense the presence of a ticket and the controller will sense an error. Ticket processing errors can results in improperly cut tickets, ticket jams and machine shut downs while repairs take place. All such events result in lost revenue from the machine.

In addition to the problems caused by fixed point location of optical sensor pairs, ticket burster machines suffer when attempting to process tickets of different thicknesses. Tickets for a single game may traditionally have nearly the identical thickness, but ticket dispensing machines are being required to process tickets of all shapes, sizes and thicknesses. As stated above, to dispense a ticket, it has to be transported between one or more pairs of rollers. The force between the feed roller pair and/or exit roller pair is called the nip force. The distance between the rollers is fixed, which works very well if only one thickness of ticket is used. However, since tickets can range from 0.006" to 0.012" (and pull-tab tickets may even be up to 0.025 inches in some places), traditional systems with fixed roller distances create many problems.

A further issue with maintaining the proper nip force is created by the use of rubber material on the rollers, since this material is susceptible to wear and tear that can reduce its thickness over time, which can change the distance between rollers and thereby compromise the nip force of the rollers.

Further, current ticket bursters suffer from the inability to keep tickets of different shapes and sizes in properly aligned format as they enter the machine. If a die-cut ticket happens to be rotated off the normal plane to the point of ticket entry in the burster machine, the cutter/burster element will not properly align with the ticket perforation, causing uneven ticket cuts and requiring that the machine be shut down.

Even further, the machine of the present invention is typically employed as part of a larger, commercial size ticket dispensing machine. In many cases, four (4) machines are aligned next to each other within the commercial machine so as to facilitate different tickets being offered by the same machine. At times, one or more individual burster machines must be removed and reinstalled for various reasons, typically for field service repair or maintenance. Typically with four machine (i.e., "quad" burster) assemblies, the four ticket bins are connected by a common frame and common drive system, and require a cable to be connected after installation to supply power and communication. To remove the quad burster, one is required to remove screws and lift away the four bins as an integrated assembly, which can be cumbersome. Also, because the four bins are inseparable, the failure of one bin will result in the failure of the remaining three bins. These and other problems are addressed by the present invention.

SUMMARY OF THE INVENTION

The present invention provides several improvements over past perforated ticket dispensing machines. The present invention provides, among other things, an independently operable and serviceable ticket burster machine that properly handles tickets of all shapes, sizes and thicknesses. The present invention includes a ticket burster element, an exit sensor with a mechanical flag switch, an inventory flag spanning the entire width of the ticket input slot and having an optical slot switch, a slidable ticket guide, one or more leaf spring arrangements, a moving wall ticket discharge facilitator and versatile and durable rollers.

The exit sensor incorporates a mechanical flag switch that is activated by the ticket media that needs to be detected. In one embodiment of the present invention, the flag switch covers the entire width of the machine. To sense the position of the flag, a Hall effect sensor can be used. The Hall effect sensor is activated by a magnetic field. The magnetic system of the exit flag includes a small magnet attached to the flag, a magnetic conductor attached to the edge of the ticket machine frame, and a Hall effect sensor attached to the ticket machine frame. The magnetic conductor helps with providing a definitive tripping point for the Hall effect sensor, which operates in a binary mode, i.e., with one output that indicates there is a magnetic connection and another output that indicates the lack thereof.

When there is no ticket in the path, the magnet is held by the magnetic force to the magnetic conductor, and the Hall sensor senses a strong magnetic field. When the moving ticket hits the exit sensor flag, it is "kicked" open. This interrupts the magnetic circuit, and once the magnet is a preferred distance (e.g., approximately 0.05 inches) away from the magnetic conductor, the Hall sensor changes its state because the magnetic field drops below the threshold of the Hall sensor. With the present invention, since a magnetic field is used, dirt and dust will have no effect on the function of the exit sensor. Further, since the flag covers the entire exit slot opening of the machine, any die cut ticket will activate the sensor. Even further, since the flag is a mechanical sensor, the ticket material has no effect. Even a soft plastic material will activate the sensor.

The present invention further provides an exit sensor flag that can reach between the exit drive and exit idler roller (inside of the frame toward the exit roller nip point). As such, it is capable of sensing tickets that are curled much more effectively. The closer the ticket can be sensed to the nip, the less it will be affected by curling. Also because there is no obstruction under the roller, the ticket can not hang up and is free to fall.

Another aspect of the present invention incorporates an inventory flag, which can "pre-nip" a ticket during the loading process and also will signal to the controller that the ticket bin still has tickets that can be dispensed. Traditionally, these inventory sensors are only checking one point (similar to the exit sensor), which creates a problem when die cut tickets are used. In one embodiment of the present invention, the inventory flag covers the entire width of the input slot of the machine. As such, any die cut ticket can be sensed. In one embodiment of the present invention, the position of the inventory flag is sensed by an optical slot switch. To make sure the inventory flag will not scratch the ticket, a very light contact force is required. This can be achieved in one embodiment of the present invention by constructing the inventory flag with a center of gravity having a very slight upwards force, so that the edge of the inventory flag on the ticket exit side is higher than the edge of the inventory flag on the ticket input side. The inventory flag can be secured to the inside walls of the machine frame by pivot attachment or cam attachment, for example.

The present invention further provides the ability to maintain high compliance regardless of the thickness of the ticket substrate being processed. The present invention accomplishes this, in part, through the use of a leaf spring arrangement that accommodates media of different sizes and thicknesses. A leaf spring is in contact with both the feed and the exit idler roller shaft. The fixed point of the leaf spring can be offset to give the feed roller more downward force. This is done by securing a spring guide to the inside of the frame at a position closer to the feed rollers than the exit rollers.

In addition to the above, the frame of the present invention can be independently inserted into and retrieved out of a larger ticket dispensing machine. As a result, the removal and installation of each bin is done separately, without the use of tools and without any secondary power cables. The single bin burster is easy to remove, and is relatively light weight such that it can be serviced and inspected quickly. Further, a moving wall can be secured to the larger ticket dispensing machine such that, when a ticket exits any ticket burster within the dispensing machine, it will be guided by the moving wall downwardly into the ticket bin.

The present invention further provides a ticket guide attached to the outside of the frame on the input slot side. The ticket guide is adapted for sliding movement along a horizontal plane and biased in the shut position such that tickets of variable widths can be securely guided with adequate pressure on both sides as they are processed through the machine. Tickets of varying widths can thus be processed with the ticket guide opening as much as necessary to accommodate the width of the ticket. This assists in maintaining proper ticket alignment during processing, which helps eliminate improper cuts and machine shut down.

BRIEF DESCRIPTION OF THE DRAWINGS

FIG. 10 is a back right perspective view of one embodiment of the ticket burster machine of the present invention, shown with ticket guide arrangement and inventory flag cover removed.

FIG. 11 is a cross-sectional side view of the interior of the ticket burster machine of FIG. 10, taken along the line 11-11 of FIG. 10, with some components removed for ease of reference.

FIG. 12 is a view similar to that of FIG. 11, shown with a ticket being processed through the ticket burster machine.

FIG. 13 is a right side schematic of the exit roller pair and exit flag according to one embodiment of the present invention.

DETAILED DESCRIPTION OF THE PREFERRED EMBODIMENTS

Figure 1:
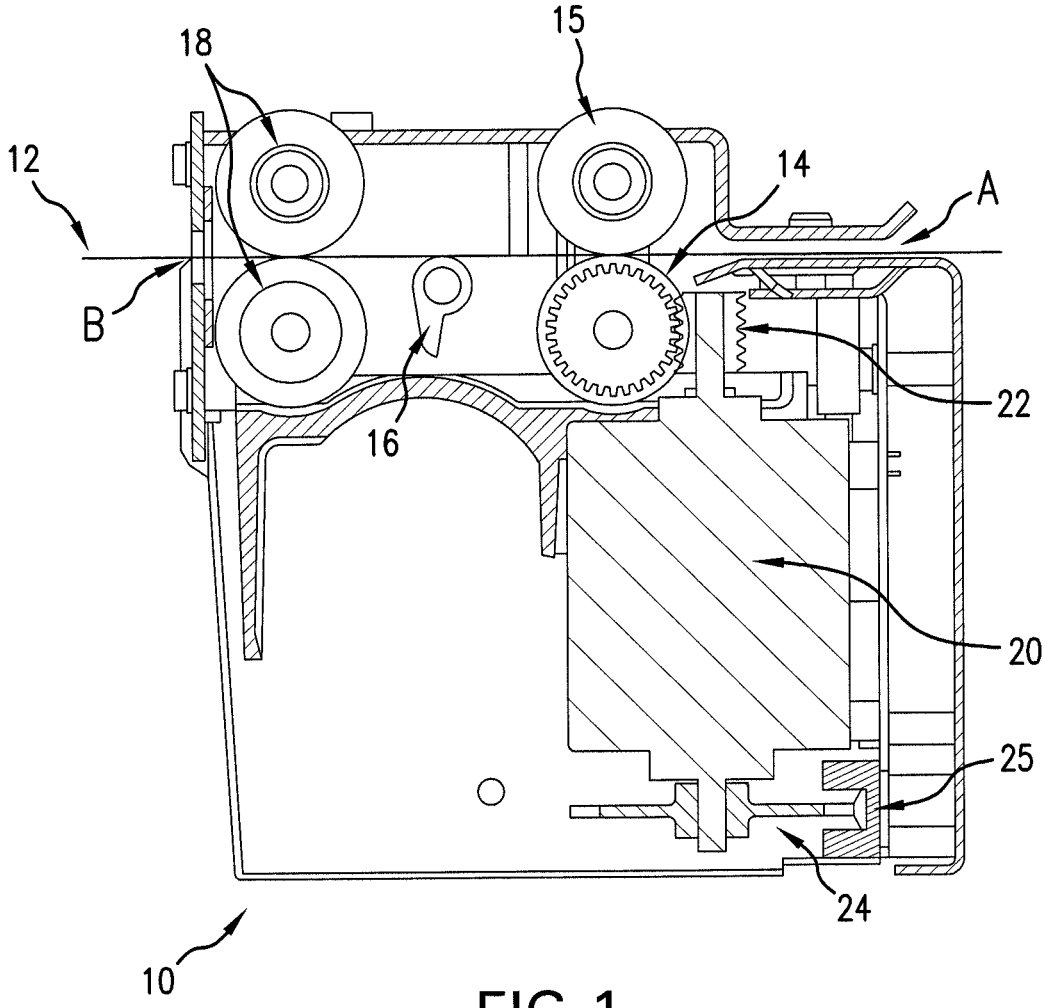
FIG. 1 is a cross-sectional view of a ticket burster machine.
Figure 2:
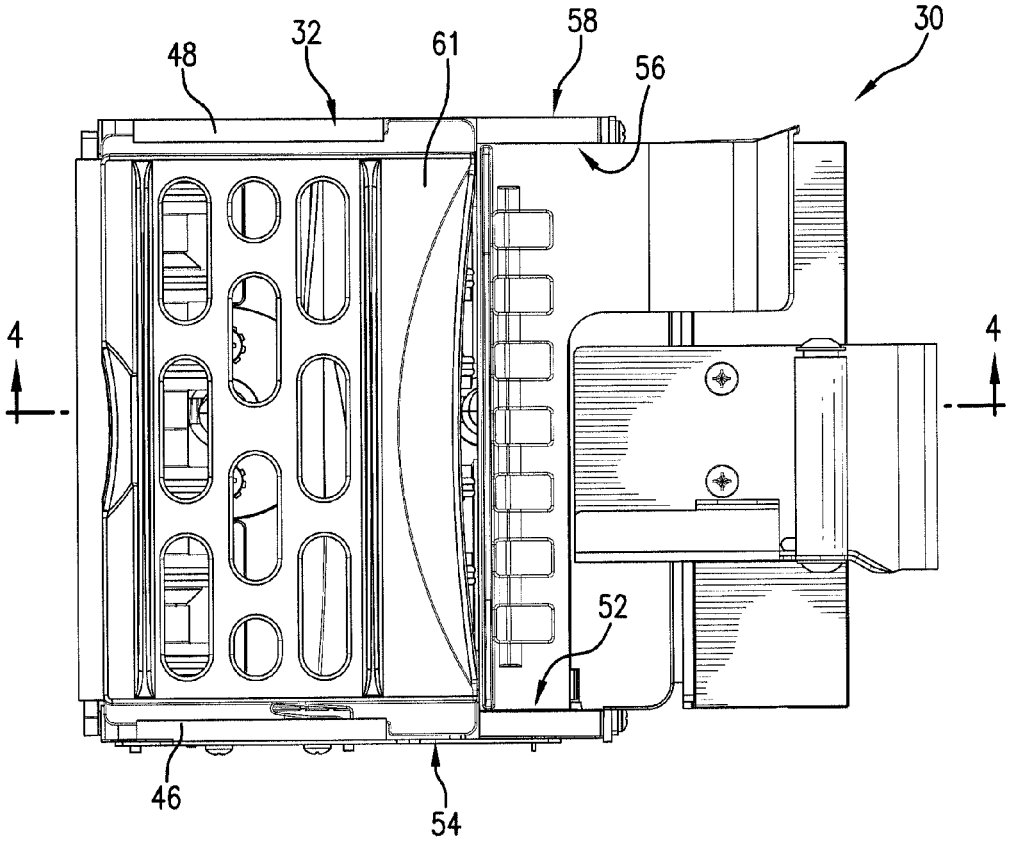
FIG. 2 is a top plan view of one embodiment of the ticket burster machine of the present invention.

The ticket burster machine of the present invention provides for controlled delivery of perforated ticket products. As shown in FIGS. 2 through 5, the ticket burster machine 30 includes a frame 32 housing a pair of feed rollers, including a feed drive roller 34 and a feed idler roller 36, as well as a pair of exit rollers, including an exit drive roller 38 and an exit idler roller 40. In one embodiment of the present invention, at least one roller on each pair of rollers is formed from aluminum and has either an aluminum oxide or silicon carbide coating. Such a coating helps resist wear and tear, and provide a high friction surface that retains proper nip force. The pair of feed rollers meet at a feed roller nip position 42 and the pair of exit rollers meet at an exit roller nip position 44.

The frame includes first 46 and second 48 side walls and can further include a back wall 50. The first side wall 46 has an inner 52 and outer 54 surface. The second side wall 48 also has an inner 56 and outer 58 surface. The back wall also has an inner surface 59 and outer surface 60. The inner surfaces of the first side wall 46, second side wall 48 and back wall 50, respectively, define the frame interior 64. A top member 61 also helps define the frame interior.

Figure 4:
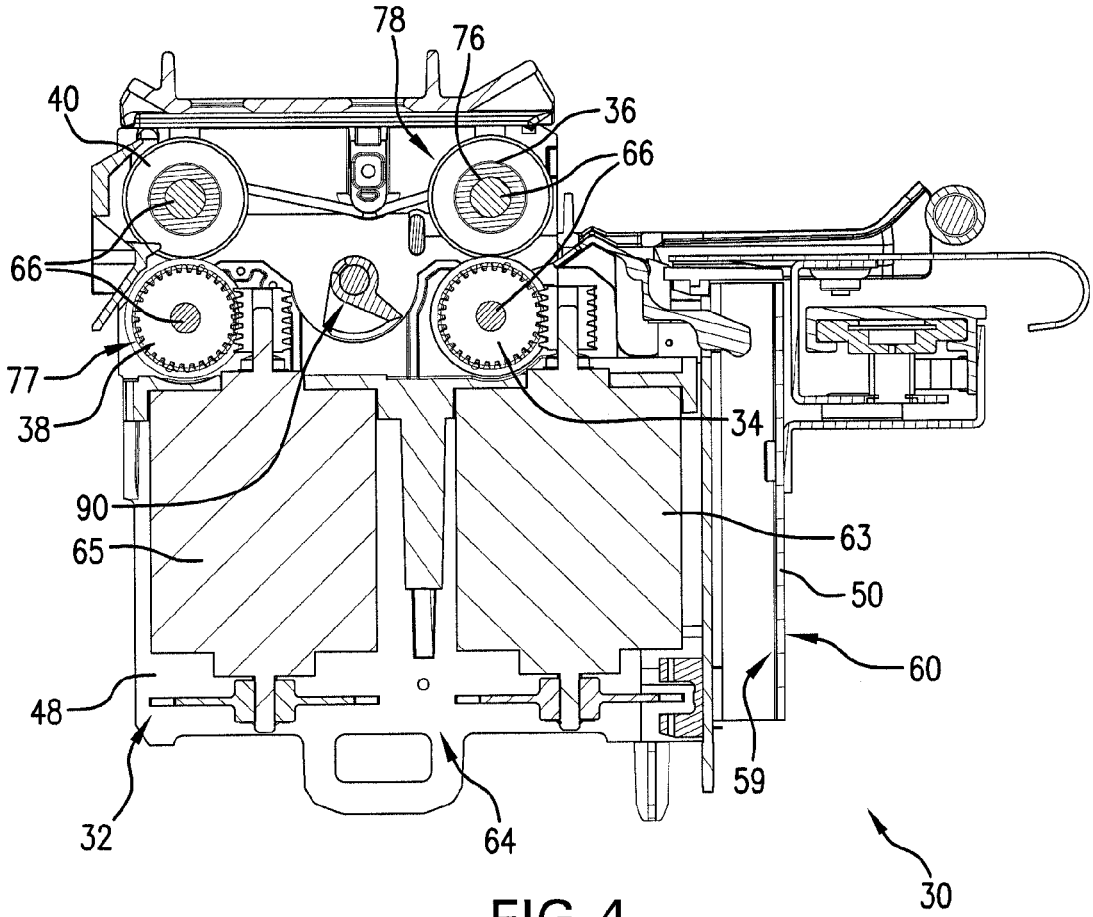
FIG. 4 is a cross-sectional side view of the ticket burster machine of FIG. 2, taken along the line 4-4 of FIG. 2.

The ticket burster machine of the present invention includes drive means for driving tickets through the machine. In one embodiment of the present invention, the drive means includes the pair of feed rollers 34, 36 and the pair of exit rollers 38, 40. The drive means can further include, for example, electrically powered motors 63, 65 that drive the feed drive roller 34 and exit drive roller 38, respectively. The feed rollers and exit rollers are driven on substantially cylindrical axles 66 that are rotatably secured at a first end 68 to the first side wall 46 and at a second end 70 to the second side wall 48. In one embodiment of the present invention, the axles 66 are maintained at their respective ends within slots 72 provided within the first 46 and second 48 side walls. In one embodiment of the invention, one or more hubs 74 are provided along the axles 66 of the feed rollers wherein the one or more hubs 74 includes a cylindrical shaft portion 76 that cooperatively mates with the axle and a radially extending head portion 78. The head portion 78 can optionally be provided with an annular groove for receiving a gripping element 82 such as a rubber ring, for example. The gripping element 82 helps to grip the tickets as they pass through the machine. In another embodiment of the present invention, the hubs 74 are not provided on the axles, but rather one or more gripping sleeves 77 are provided over the axles to assist in gripping the tickets. In one embodiment of the present invention, a series of hubs 74 is provided on each of the idler rollers and one or more gripping sleeves 77 is provided on each of the drive rollers, as shown in FIG. 4.

One of the challenges with using a rubber compound on the rollers to create enough friction for pulling tickets through the machine is that the rubber compound will age and wear over time, which reduces its diameter and thus its gripping ability. This can also have the effect of not processing the tickets or positioning the perforation properly. In addition, the rubber compound can collect dust that is emitted every time a perforated ticket is burst. As a result, one embodiment of the present invention uses an aluminum oxide or silicon carbide surface treatment on the drive rollers. Both of these materials are very hard, and can be bonded to an aluminum cylinder (i.e., axle). Also, both materials are available in a wide variety of grain sizes. In this embodiment of the present invention, the coatings can be applied at approximately 0.01 inches in thickness. The thickness and grit of the applied material can be selected to produce high friction while improving immunity to paper dust.

In one embodiment of the present invention, one or more printed circuit boards is attached to the frame to carry out instructions provided by a processor or controller connected to the device. The instructions can be stored as part of an operating program contained in a memory accessible by the controller. In one embodiment of the present invention, the electronic communications, controller, memory, programming and printed circuit board(s) can be considered part of the drive means of the present invention.

As further shown in FIGS. 2 through 5, the present invention also includes a burster element 90 rotatably secured within the frame interior at a first end 92 to the first side wall 46 and at a second end 94 to the second side wall 48. The burster element 90 can comprise, for example, a sleeve placed around a cylindrical axle, wherein the sleeve includes a substantially helically shaped flange extending therefrom. When rotated against a ticket, the helical flange puts tearing pressure on one portion of a perforated ticket connection at a time, thereby effectively simulating a manual tearing motion. In one embodiment of the present invention, the burster element can be a blade or sharpened edge that acts to cut passing tickets at the perforated edge. The burster element is positioned between the feed rollers and the exit rollers, going from back to front of the device. The burster element is also positioned between the drive rollers and the idler rollers, going from bottom to top of the device. Rather than being mounted for rotation in a slot within the first and second side walls, the ends of the burster element can be mounted within substantially circular openings within the side walls, respectfully. Nevertheless, the manner in which the axle of the burster element resides within the side walls of the frame of the present invention is not critical, and can be accomplished in any of a number of ways. The burster element can also be driven by an electrically powered motor, wherein the motor is in communication with the controller so as to know when to activate the burster.

As shown in FIGS. 7 through 12, the present invention further includes an input slot flag arrangement 98 on the ticket input side and an exit flag arrangement 100 to facilitate accurate and effective ticket processing through the machine. The input slot flag arrangement 98 comprises an input optical sensor pair and an inventory flag 104 pivotably secured between the first side wall 46 and the second side wall 48. The inventory flag is used to "pre-nip" a ticket during the loading process, and will also signal to the controller that the bin still has tickets left to dispense. As noted above, prior inventory flags only check a single point, which does not help in the event die-cut tickets are employed.

The optical sensor pair includes a transmitter and a receiver, and can sense whether the inventory flag 104 has been pressed down, indicating the entry of a ticket into the input slot 106 of the device. For instance, as shown in FIG. 11, the inventory flag 104 is in the resting position and the transmitter is emitting a signal (represented at 102) that travels in a direction parallel to the axis AA of the inventory flag 104. When a ticket 121 enters the machine, as shown in FIG. 12, it depresses the inventory flag 104 such that the flag blocks the transmission of the signal from the transmitter to the receiver. The optical sensor pair can be secured to the burster machine such that the transmitter is secured on or near one of the side walls, and the receiver is secured on or near the other side wall. In one embodiment of the present invention, the inventory flag has an incoming ticket side edge 107 and an exiting ticket side edge 109, and further is constructed with a center of gravity that biases its exiting ticket side edge 109 slightly upward, as shown in FIG. 11. In this way, the inventory flag 104 rests in a position whereby the optical sensor pair knows there is no ticket in place, because the signal is able to travel from the transmitter to the receiver without interruption. In one embodiment of the present invention, the center of gravity of the inventory flag is biased through the use of a counterweight in the lower section 111 of the inventory flag. While no springs are required to return the inventory flag to its resting position after the passing of a ticket, it will be appreciated that one or more springs can be employed under the inventory flag for this purpose. It will further be appreciated that the sensor pair need not necessarily comprise an optical sensor pair. For example, a magnetic arrangement can also be employed in conjunction with the inventory flag to serve the same purpose as the optical sensor pair described. In one embodiment of the present invention, the inventory flag 104 is pivotably secured between the first 46 and second 48 side walls at a position substantially along the incoming ticket side edge of the inventory flag 104.

The exit sensor has two functions in a ticket burster machine. First, it needs to sense the edge of a ticket so that it can precisely position the perforation for bursting. Second, it needs to sense that the ticket has been properly dispensed from the machine. Exit sensors operating with optical sensors have been described above, along with their known deficiencies. The present invention helps overcome those deficiencies by providing an exit flag arrangement including an external magnet component. As shown in FIGS. 6 through 12, the exit flag arrangement 100 of the present invention incorporates, in one embodiment, an exit flag 114 pivotably secured to the first 46 and second 48 side walls, a Hall effect sensor 116 secured to the outer surface of the first side wall 46, a magnetic conductor 118 secured to the outer surface of the first side wall 46, and a magnet 120 secured to the exit flag 114.

Figure 6:
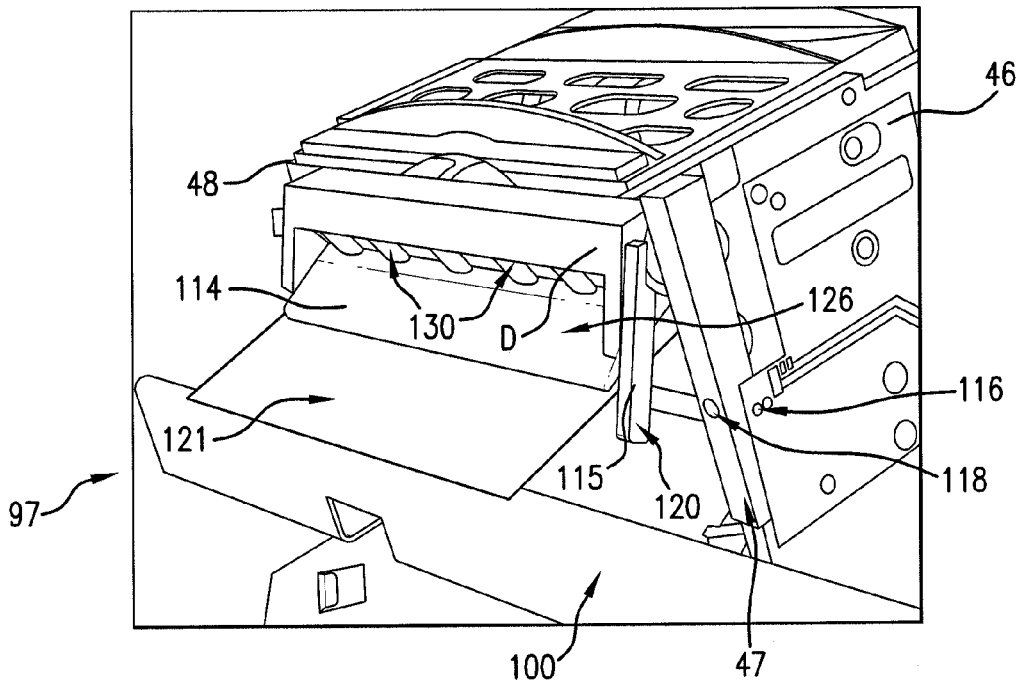
FIG. 6 is a front right perspective photograph of one embodiment of the ticket burster machine of the present invention, with exit flag being kicked out by a ticket.
Figure 8:
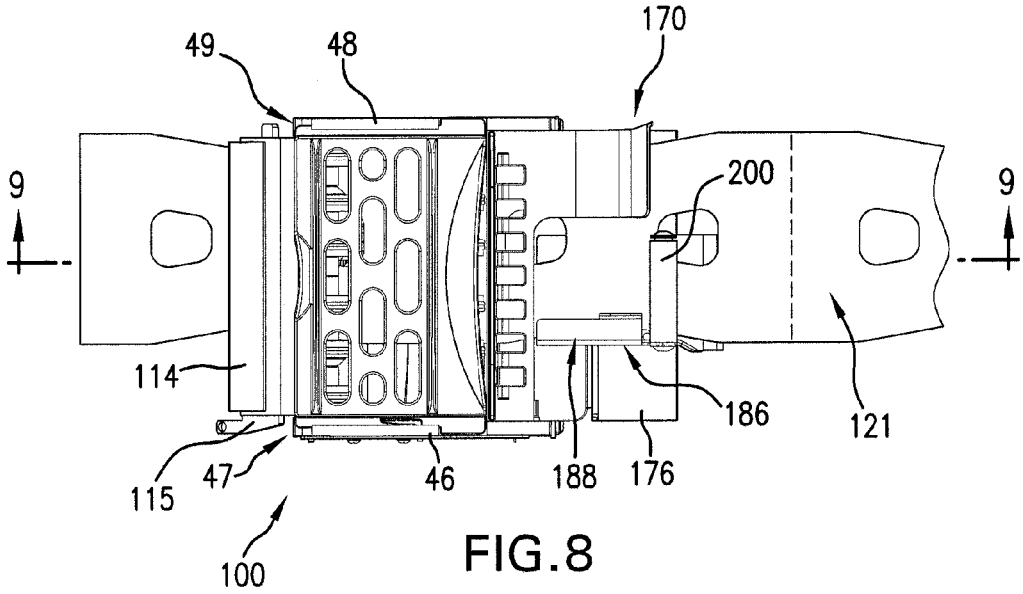
FIG. 8 is a top plan view of one embodiment of the ticket burster machine of the present invention, shown with a ticket stream being processed through the exit assembly of the present invention.
Figure 9:
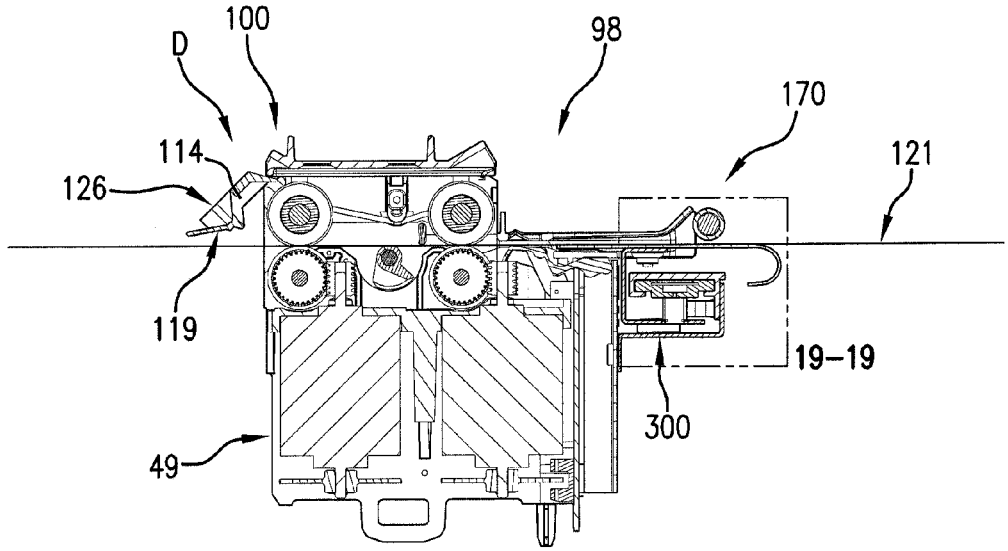
FIG. 9 is a cross-sectional side view of the ticket burster machine of FIG. 8, taken along the line 9-9 of FIG. 8.

As shown in FIGS. 6 and 8, the first side wall 46 includes a back edge 47, and the exit flag 114 includes a first flange element 115 that contacts the first side wall back edge 47 when the exit flag 114 is in a resting position. Additionally, the magnetic conductor 118 can be secured within an opening in the back edge 47 of the first side wall 46, while the magnet 120 is secured within an opening in the first flange element 115. In one embodiment of the present invention, the second side wall 48 includes a back edge 49, and the exit flag 114 includes a second flange element (not shown) that contacts the second side wall back edge 49 when the exit flag 114 is in a resting position.

Figure 5:
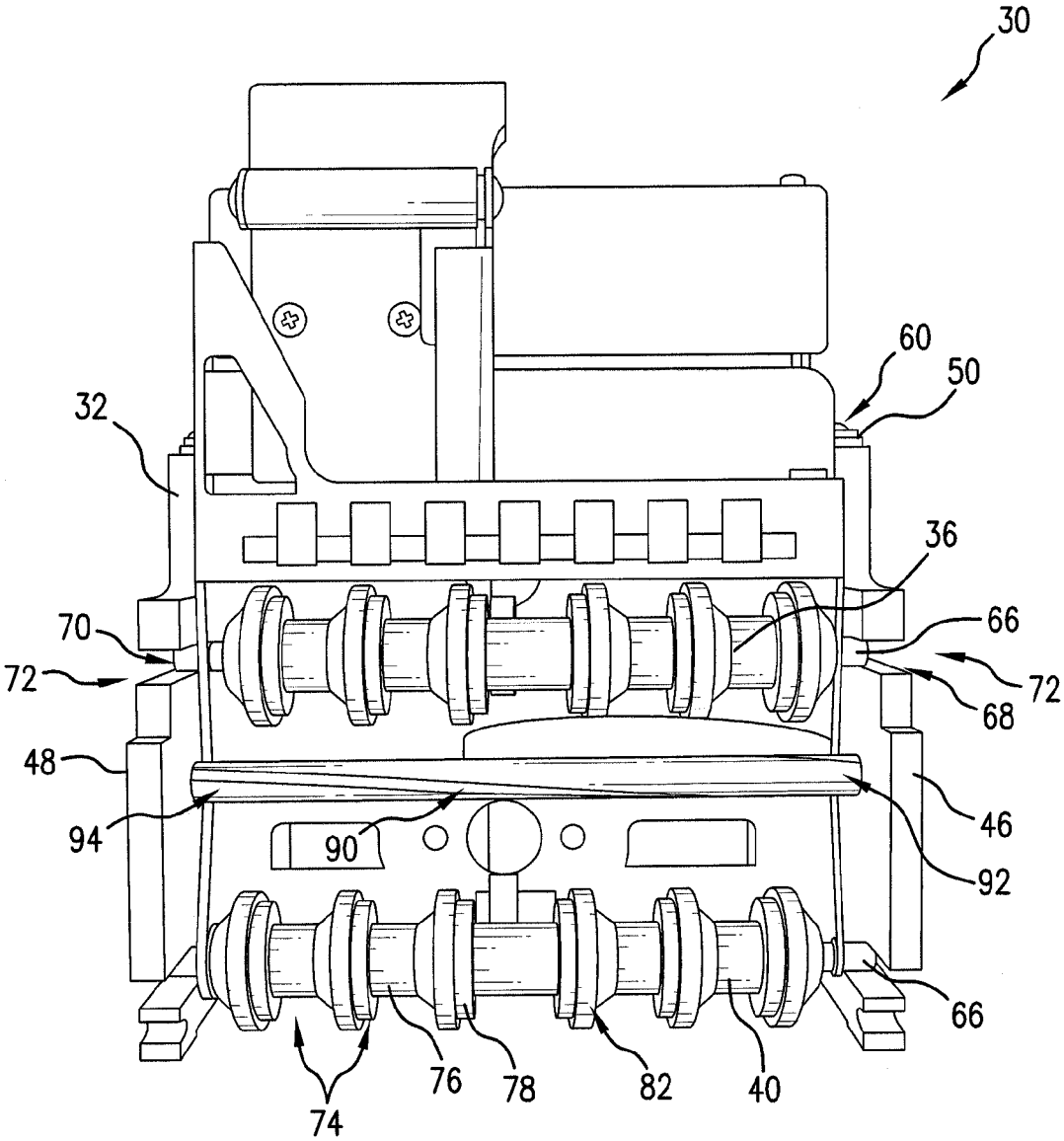
FIG. 5 is a top photographic view taken from the front side of one embodiment of the ticket burster machine of the present invention, with top and exit flag arrangement removed.

The exit flag 114 has an inner 119 and an outer 126 surface and is pivotable from a resting position C to an extended position D (see FIGS. 9, 11 and 13), wherein the exit flag 114 is maintained in the resting position C by the attraction of the magnet 120 to the magnetic conductor 118. A cylindrical sheath or other element on the exit flag can cooperate with a pivot rod 129 to enable the pivoting motion of the exit flag. When the drive means transmits a ticket 121 through the feed rollers, it hits the exit flag inner surface 119 and thereby overcomes the magnet's force, as shown in FIG. 5, moving the exit flag 114 out of the resting position C and toward the extended position D, and permitting the ticket 121 to exit the frame interior.

The Hall effect sensor 116, prior to any ticket passing through the machine, senses a strong magnetic field. When the moving ticket kicks the flag open, the Hall effect sensor senses the lack of a strong magnetic field, and thereby changes its state due to the magnetic field measurement falling below a pre-defined threshold. This change in state results in an electronic communication to the controller to note that the ticket has been properly dispensed. Since a magnetic field is employed, the existence of dust and dirt will have no effect on the operation of the exit flag arrangement of the present invention. Further, since the flag covers the entire opening between the side walls on the exit side of the device, it will be pushed open by a ticket of any shape or size, including die-cut (e.g., irregular, non-rectangular) tickets. Further, since the flag is a mechanical sensor, the ticket media material has no effect on the operation of the device.

As described above, the pair of exit rollers 38, 40 meet at an exit roller nip position 44. In one embodiment of the present invention as shown in FIG. 13, at least one portion 125 of the exit flag 114 extends inward of the plane E defined by the back edges of the rollers 38, 40 and into the frame interior towards the exit roller nip position 44. In one embodiment of the present invention, as shown in FIGS. 6 and 12, the exit flag 114 includes several baffles 130, and these baffles can extend inwardly of plane E in FIG. 13 to a position that is radially between the core cylindrical element 66 of the exit idler roller 40 and the hubs 74 of the exit idler roller 40. In other words, the core cylindrical element has a first radius that is smaller than that of the hubs, which have a second radius. The exit flag baffles 130 extend to a position that has a radial distance from the core cylindrical element or axle 66 that is less than the difference between the hub radius and the core cylindrical radius. In this way, the exit flag arrangement can sense when a ticket 121 has been curled up, for example. The closer to the nip point a ticket can be sensed, the easier it is to handle any curls. For instance, if the exit flag had no baffles and did not sense a ticket until it reached a point that crosses plane E, then the burster may not burst a curled ticket exactly at the perforation line, because more ticket would have passed through the nip point prior to being sensed.

Figure 3:
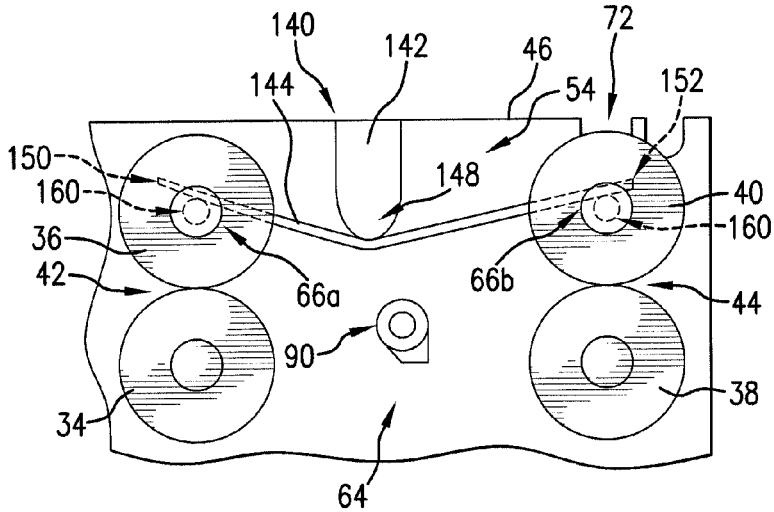
FIG. 3 is a schematic internal left side view of elements of the ticket burster machine of the present invention.

The leaf spring arrangement of the present invention is another element that assists in controlling the processing of tickets through the machine. FIG. 3 shows a leaf spring arrangement 140 mounted on the inner surface 54 of side wall member 46. The leaf spring arrangement 140 provides downward pressure on the axles 66 of the feed 36 and exit 40 idler rollers to assist the device of the present invention in handling tickets of different thicknesses, among other things. Since ticket media can range from 0.006 inches to 0.012 inches, and since pull-tab tickets can go up to 0.018 inches (and even 0.025 inches at the "tent" or bump surrounding the perforation), having a fixed distance between respective drive and idler roller pairs is not as effective as if the ticket media thickness were constant. As a result, the present invention employs one or more leaf spring arrangements to ensure a highly compliant device that does not require a fixed distance between rollers.

As further shown in FIG. 3, the leaf spring arrangement 140 includes a leaf spring guide member 142 secured to the inner surface 54 of the first side wall 46. In one embodiment of the present invention, the leaf spring guide member 142 is secured at a position nearer to the feed idler roller 36 than the exit idler roller 40. This positioning is helpful in that it places a greater amount of downward pressure on the feed roller axle when a ticket is first detected in the burster machine. In one embodiment of the present invention, as described above, each roller pair has a respective motor driving it. In this arrangement, the feed roller acts as the "intelligent" roller pair with more nipping force, preventing the exit roller from overcoming the force of the feed roller and pulling tickets through the machine.

A leaf spring 144 engages the downward facing end portion 148 of the leaf spring guide member 142 and has first 150 and second 152 ends. The leaf spring 144 cooperatively engages the feed idler roller axle 66*a* at or near the leaf spring first end 150 and cooperatively engages the exit idler roller axle 66*b* at or near the leaf spring second end 152. In one embodiment of the present invention, leaf spring arrangements are provided on the inner surfaces 54, 56, respectively, of the first side wall 46 and the second side wall 48. This balances the load placed on the axles. In one embodiment of the present invention, one or both of the cylindrical axles (on which the rollers are mounted) includes a channel 160 therein for cooperatively engaging the first leaf spring.

Figure 17:
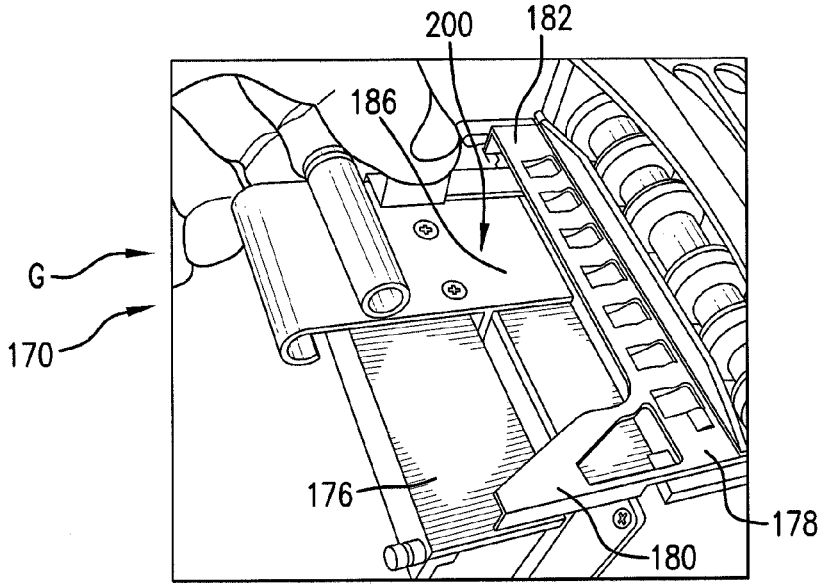
FIG. 17 is a top back left perspective photograph of the embodiment of the ticket guide assembly of the present invention in FIG. 16, shown with the ticket guide in an open position.

As shown in FIGS. 7 through 9, 15 through 17 and 19, the ticket guide 170 of the present invention is attached to the outside of the frame 32 of the ticket burster machine 30 of the present invention on the ticket input side. The ticket guide 170 is adapted for sliding movement along a horizontal plane and biased in the shut position F such that tickets of variable widths can be securely guided with adequate pressure on both sides as they are processed through the machine. FIG. 17 shows the ticket guide being held in the open position G. Tickets of varying widths can thus be processed with the ticket guide opening as much as necessary to accommodate the width of the ticket.

As further shown in the drawings, one embodiment of the ticket guide arrangement 170 of the present invention comprises: (1) a guide retainer element 176 secured to the back wall outer surface 60; (2) an inventory flag cover 178 secured between the first 46 and second 48 side walls, with the flag cover 178 having at least one side wall arm 180 and upper 182 and lower 184 horizontal platforms extending therefrom; and (3) a ticket guide 186 slidably engaging the guide retainer element 176, with the ticket guide 186 having a left side wall arm 188. The guide retainer element 176 includes a bottom element 300 having left and right side stop flanges (not shown), and further includes a top element 304 having front 306, back 308 and top 310 walls that define a channel 312 for receiving the ticket guide stabilizer arm 314. The ticket guide 186 includes a ticket platform 200 and further includes a ticket roller 202 secured to the left side wall arm 188. The ticket platform 200 is positioned at least partially above the lower horizontal platform 184 of the flag cover 178, and the ticket guide 186 further is secured to a guide arm 320 that is capable of engaging the left and right side stop flanges of the guide retainer element 176. The guide arm 320 is secured to a channel bar 322 that is capable of cooperatively engaging the guide retainer element channel 312.

In operation, the ticket guide 186 is slidable within the guide retainer element 176 such that the ticket platform 200 retains a position at least partially above the inventory flag cover lower platform 184 while the channel bar 322 is retained within the channel 312 of the guide retainer element 176. This helps to maintain the ticket guide in substantially horizontal position as it slides back and forth to accommodate tickets of variable widths. As tickets enter the input side of the machine, they can be securely guided with adequate pressure on both sides from the ticket guide. In combination with the leaf spring attachments, the present invention thus accommodates tickets of varying shapes, sizes, widths and thicknesses with equal adeptness.

Figure 7:
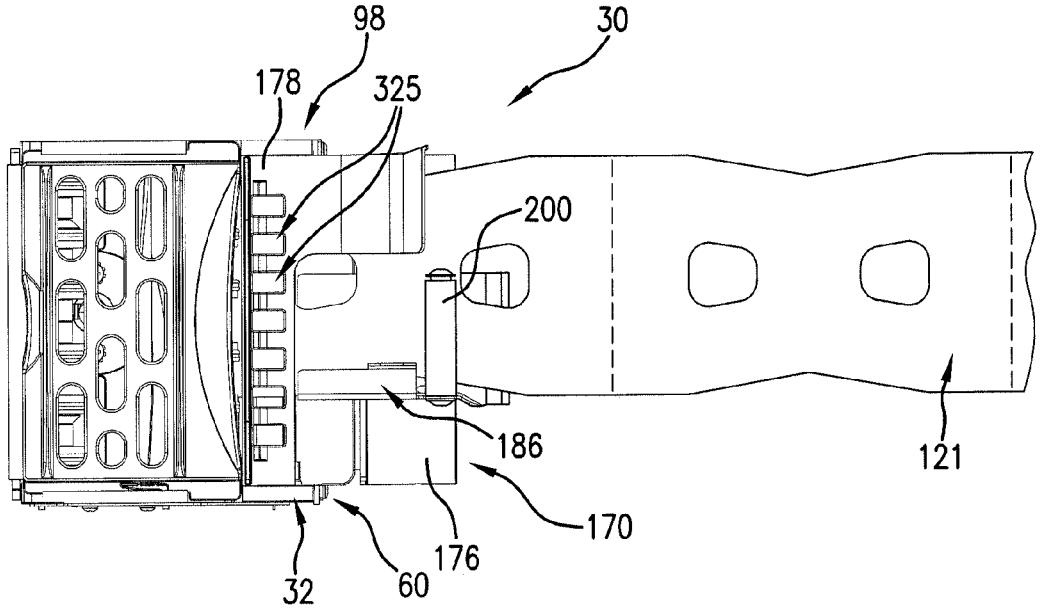
FIG. 7 is a top plan view of one embodiment of the ticket burster machine of the present invention, shown with a ticket stream inserted.

In one embodiment of the present invention, the inventory flag cover upper platform 182 is formed with a plurality of openings 325 as shown in FIG. 7, which act as a window for viewing the inventory flag 104 thereunder.

Figure 14:
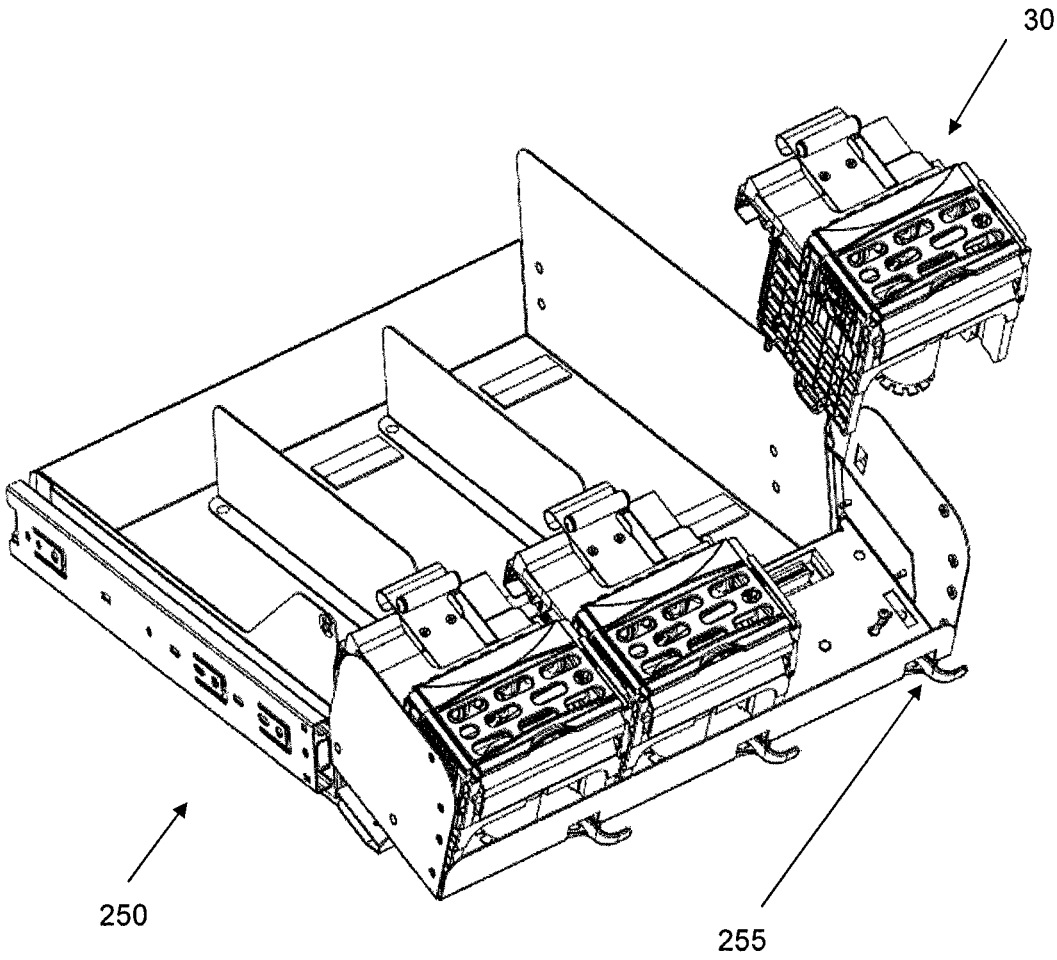
FIG. 14 is a front left perspective view showing three individual burster machines according to the present invention within a larger ticket dispensing machine.
Figure 15:
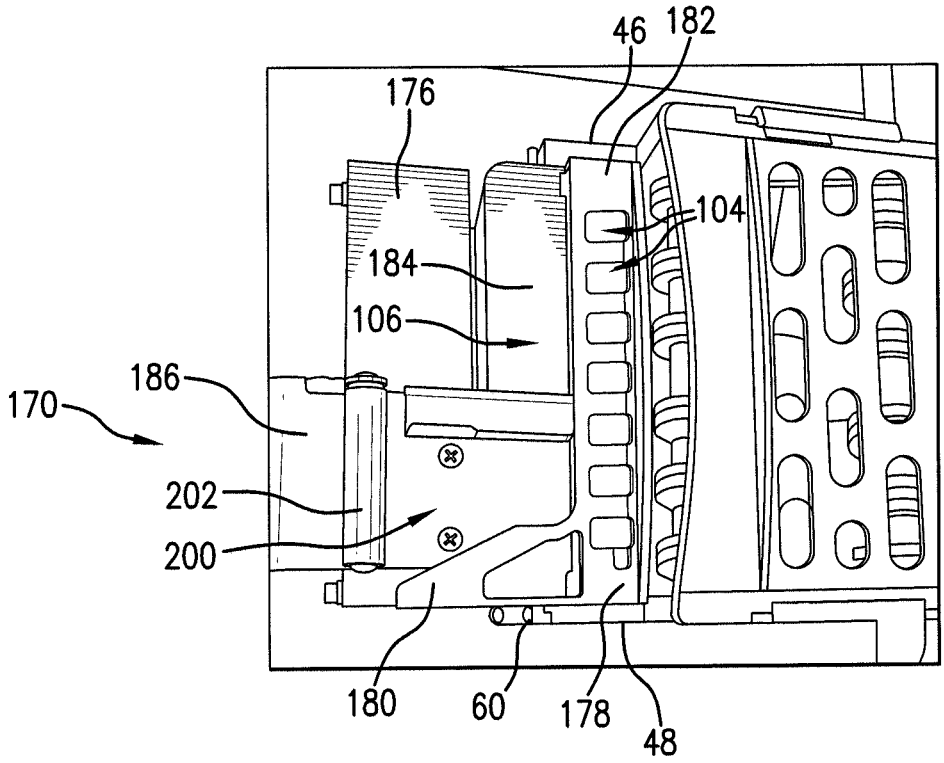
FIG. 15 is a top plan view photograph taken from the right side of one embodiment of the present invention.
Figure 16:
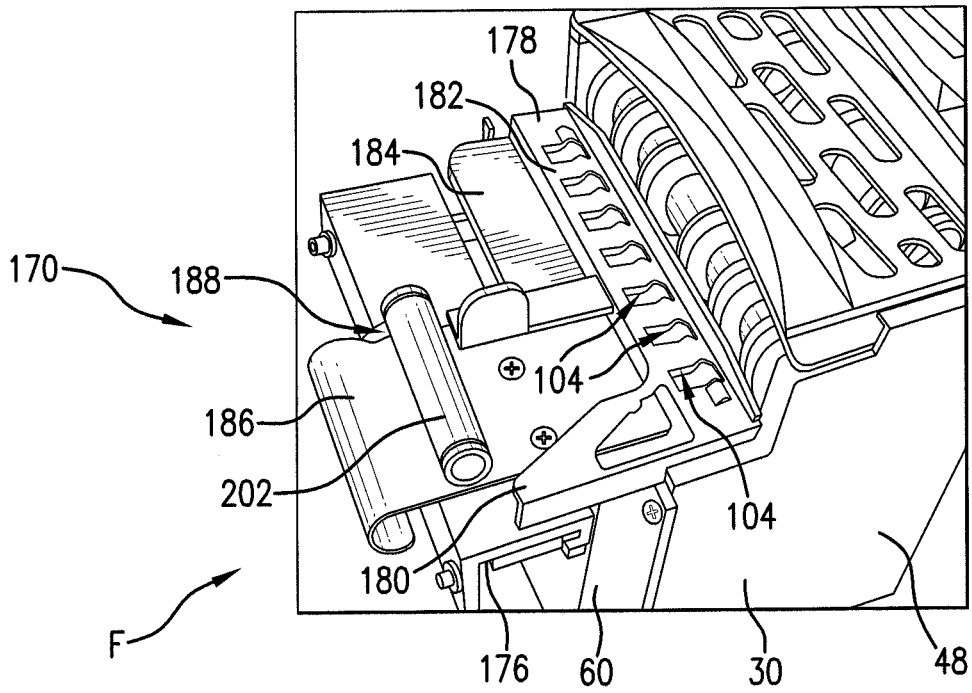
FIG. 16 is a top back left perspective photograph of one embodiment of the present invention, shown with the ticket guide in the fully biased position.
Figure 18:
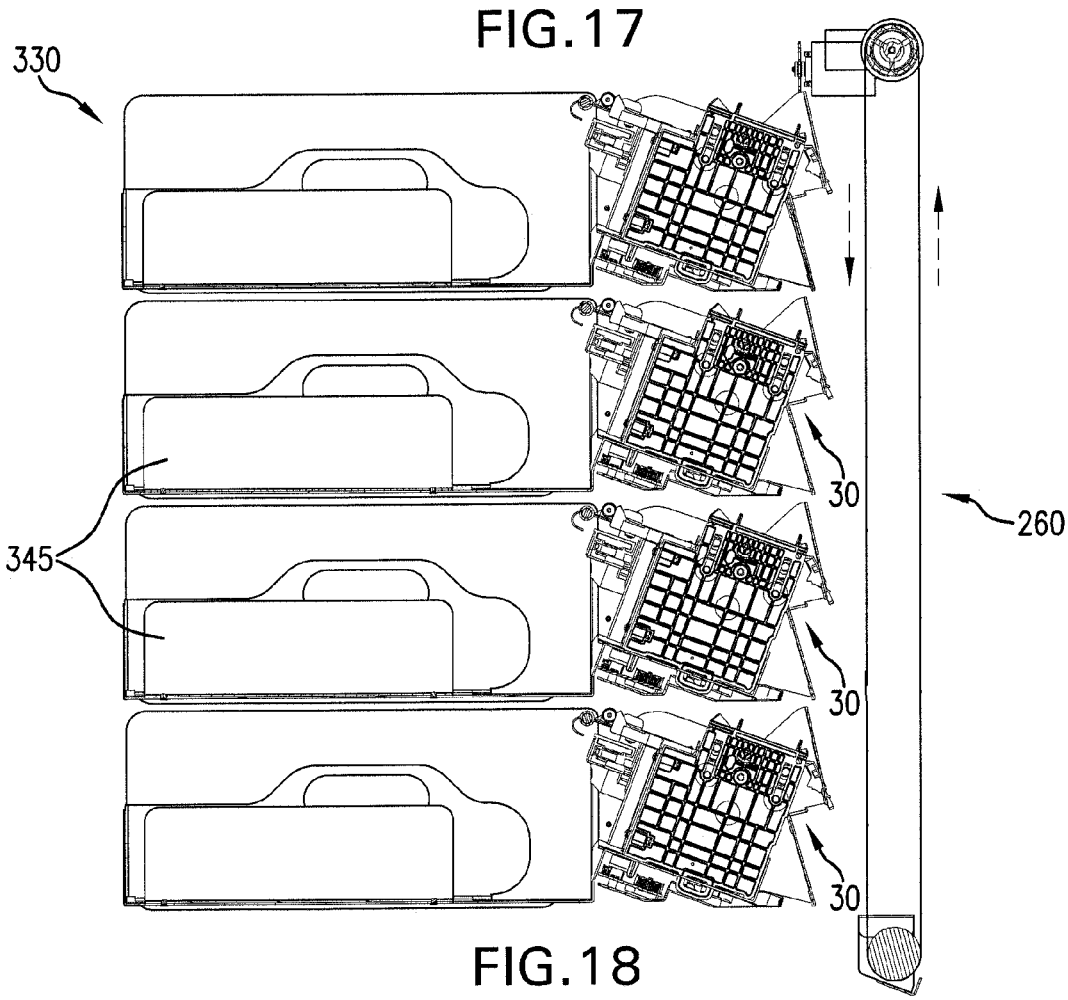
FIG. 18 is a side schematic view of a series of ticket burster machines within a larger ticket dispensing apparatus in accordance with the present invention, shown with a moving wall.
Figure 19:
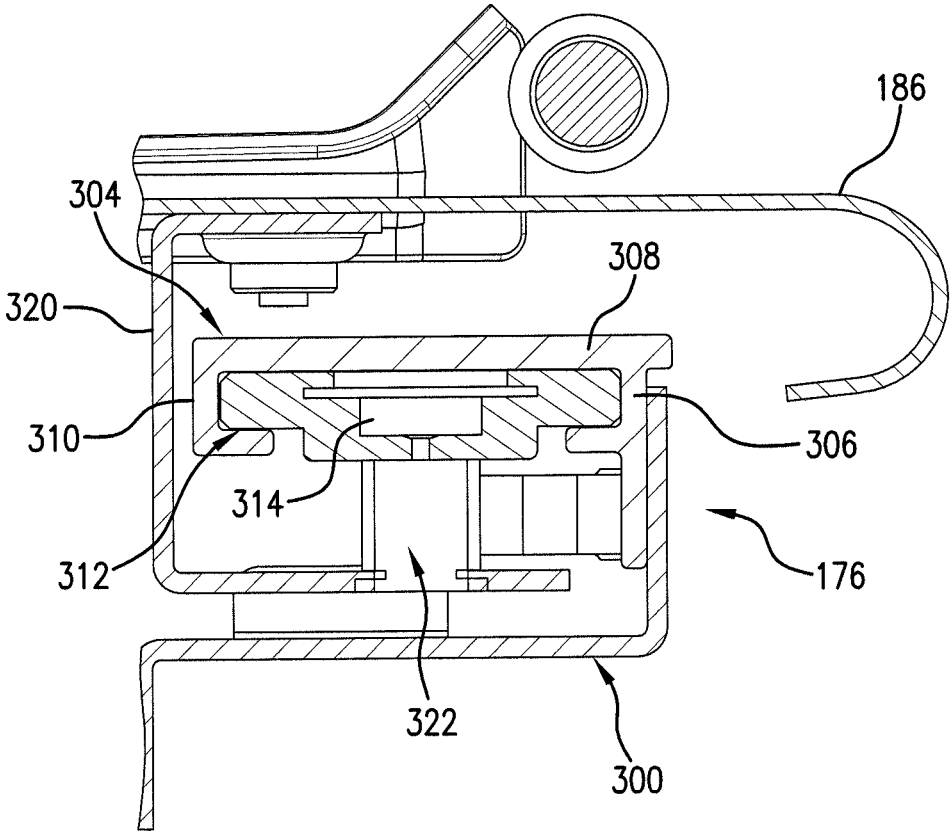
FIG. 19 is an exploded view of the portion of FIG. 9 identified as 19-19 in dotted lines.
Figure 20:
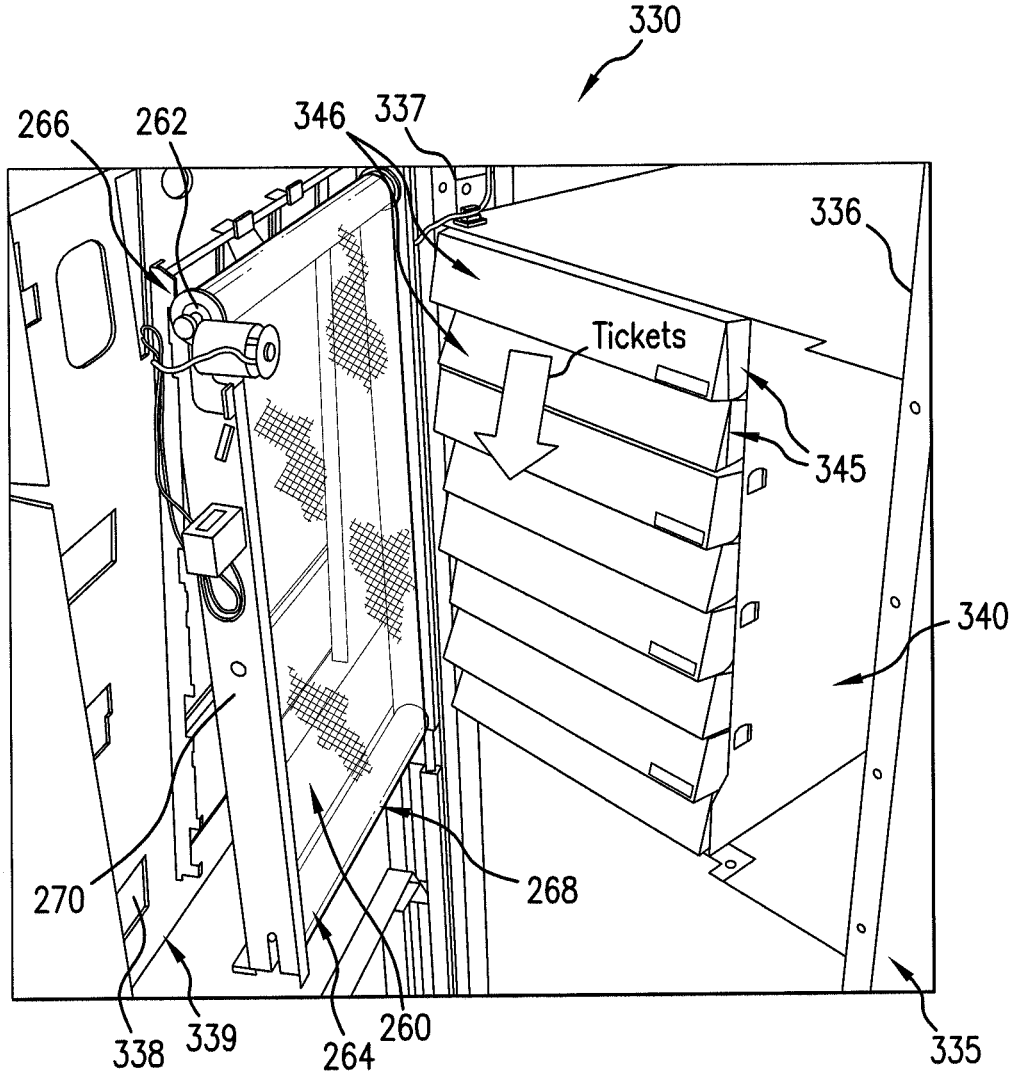
FIG. 20 is a photograph of a ticket dispensing machine incorporating a moving wall in accordance with one embodiment of the present invention.

In the embodiment of the present invention as shown in FIG. 14, the ticket burster machine 30 can be independently inserted into and retrieved out of a larger ticket bin or drawer 250 that is part of a larger ticket dispensing machine. In one embodiment of this aspect of the invention, a handle 255 can be used to release the burster machine from the bin 250. Additionally, as shown in FIGS. 18 and 20, the present invention can be incorporated with a machine 330 that has a media chute with a moving wall or conveyor belt 260 such that tickets exiting the burster machine(s) 30 will be guided downward so as to help avoid jamming in the machine. The ticket dispensing machine 330 can be provided with a housing 335 having a plurality of walls 336, 337, 338 that define an interior section 340 of the housing 335, with one or more drawers 250 mounted within the interior section 340 of the housing 335 and having a plurality of chambers for receiving the ticket buster machines, similar to that shown at 250 in FIG. 14. The moving wall apparatus 260 can be secured to the interior surface 339 of the front wall 338 of the housing 335 such that, when the front wall or door 338 is shut, the moving wall 260 is in position near the front ends 346 of the drawers 250 and thus alongside the exit flag arrangements of the ticket bursting machines. In this way, tickets leaving the ticket bursting machines are influenced downward by the moving wall apparatus, as indicated by the arrow in FIG. 20.

The moving wall 260 can be operated as a conveyor belt oriented vertically within the media chute. As shown in FIG. 20, the moving wall 260 can contain a drive roller 262 and an idler roller 264 rotatably secured at or near the top 266 and bottom 268 of a moving wall frame 270, respectively. The drive roller is operably connected to a motor for driving the conveyor belt. In one embodiment of this aspect of the present invention, the belt comprises a mesh screen, wherein the mesh size can range from ⅛ inch to ½ inch, for example. Mesh sizes outside of this range can also be employed. In a further embodiment of this aspect of the present invention, the belt can comprise a polyester material that is covered and/or coated by vinyl. The belt runs such that the surface facing the front of the array of bursters is moving down towards the distribution bin, as indicated by the dotted arrows in FIG. 18. The conveyor moving in this direction deflects media downward and continues to assist travel for the full length of the chute. This also helps to prevent media from becoming wedged or bridging two opposing static walls of the chute. In addition to facilitating proper ticket travel by motion, the belt facilitates ticket travel by creating an electrostatic charge that attracts the ticket media to the belt, essentially "grabbing" each ticket as it is dispensed by the respective ticket burster machine and carrying the ticket downward.

In one embodiment of this aspect of the present invention, the wall is not moved as a conveyor, but rather is shaken or vibrated, such as by an electrically powered vibration device, for example. In another embodiment of this aspect of the present invention, the belt incorporates bumps, protrusions or other elements that enhance the friction between the belt and ticket media. In a still further embodiment of this aspect of the present invention, multiple belts are employed.

The invention may be embodied in other specific forms without departing from the spirit or essential characteristics thereof The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

The invention claimed is:

1. A ticket burster machine for controlled delivery of perforated ticket products, comprising:

a frame having first and second side walls, with the side walls each having an inner and outer surface, the inner surfaces of the side walls together defining a frame interior, and with drive means secured within the frame interior for moving tickets therethrough, wherein the drive means comprises a feed drive roller, a feed idler roller, an exit drive roller and an exit idler roller;

a bursting element secured within the frame interior;

an input slot flag arrangement having an inventory flag that extends from the first side wall to the second side wall;

an exit flag pivotably secured to the first and second side walls;

a controller in communication with the inventory flag and exit slot flag;

at least one leaf spring arrangement mounted to the inside of the frame for applying pressure to the feed and exit idler rollers; and a ticket guide arrangement including a ticket guide slidably secured to a guide retainer element that is secured to the frame, such that tickets of variable widths can be securely guided with adequate pressure on both sides as they are processed through the machine; and wherein the leaf spring arrangement includes a leaf spring guide member secured to the inner surface of the first side wall at a position nearer to the feed idler roller than the exit idler roller.

2. The machine of claim 1 wherein at least one of the rollers is formed from aluminum and has either an aluminum oxide or silicon carbide coating.

3. The machine of claim 1 wherein the exit flag is part of an exit flag arrangement that includes a Hall effect sensor secured to the outer surface of the first side wall, a magnetic conductor secured to the first side wall and a magnet secured to the exit flag.

4. The machine of claim 1 wherein the exit drive and idler rollers meet at an exit roller nip position, and wherein the exit slot flag extends inward of the frame towards the exit roller nip position.

5. The machine of claim 1 wherein the exit idler roller includes a core cylindrical element having a first diameter and at least one roller member element secured thereto and having a second diameter, and wherein the exit flag includes at least one baffle that can extend to a position that is radially between the core cylindrical element and the roller member element.

6. The machine of claim 1 wherein the inventory flag has an incoming ticket side edge and an exiting ticket side edge, and wherein the inventory flag is constructed with a center of gravity that biases the exiting ticket side edge upward.

7. The machine of claim 1 wherein the frame can be independently inserted into and retrieved out of a larger ticket dispensing machine.

* * * * *